US007794166B2

(12) United States Patent
Zhang

(10) Patent No.: US 7,794,166 B2
(45) Date of Patent: Sep. 14, 2010

(54) PRESS-TYPE COSMETIC CONTAINER WITH ANTI-PRESS MEANS

(75) Inventor: Jun Zhang, Taipei County (TW)

(73) Assignee: Chuen Chern Co. Ltd., Taipei County (TW)

( * ) Notice: Subject to any disclaimer, the term of this patent is extended or adjusted under 35 U.S.C. 154(b) by 838 days.

(21) Appl. No.: 11/693,301

(22) Filed: Mar. 29, 2007

(65) Prior Publication Data

US 2008/0240839 A1 Oct. 2, 2008

(51) Int. Cl.
*B43K 5/06* (2006.01)

(52) U.S. Cl. ..... 401/179

(58) Field of Classification Search ..... 401/171, 401/176, 179
See application file for complete search history.

(56) References Cited

U.S. PATENT DOCUMENTS 6,702,158 B2 * 3/2004 Kageyama et al. ..... 222/386
7,044,673 B2 * 5/2006 Endou ..... 401/205
7,086,796 B2 * 8/2006 Severa ..... 401/179

* cited by examiner

*Primary Examiner*—Huyen Le

(57) ABSTRACT

The present invention is related to a press-type cosmetic container with an anti-press means. That is, a cosmetic container adopts the way of pressing to output the material therein. More particularly, the press cover of the cosmetic container is stopped by a block to prevent discharging or leaking the material in the cosmetic container.

6 Claims, 5 Drawing Sheets

PRESS-TYPE COSMETIC CONTAINER WITH ANTI-PRESS MEANS

BACKGROUND OF THE INVENTION

1. Field of the Invention

The present invention generally relates to a press-type cosmetic container with an anti-press means, more particularly to a container preventing the leakage of cosmetic liquid.

2. Description of the Prior Art

While a woman or girl is on make-up, a cosmetic pencil is playing an important role at the moment. Turning the cosmetic pencil for make-up is the present way, and if a mirror is another tool for make-up, how to handle the cosmetic pencil and the mirror is a trouble for the woman or girl. Hence, a press-type cosmetic container is then developed for marketing. And a problem accompanied simultaneously, that is, cosmetic liquid in the container may be leaked out while pressing. Therefore, to develop a cosmetic container with anti-press means is an important issue for the persons skilled in the art.

SUMMARY OF THE INVENTION

The primary objective of the present invention is to provide a press-type cosmetic container with an anti-press means comprising: a tube member having a sleeve at the one end thereof, the outer edge of the sleeve being disposed a collar base; a rotating tube member being disposed a female ringing slot at the inner edge of the one end thereof, the rotating tube member being female-connected to the outer edge of the sleeve and the collar base of the tube member being slid on the female ringing slot so as to make the rotating tube member be turned around on the sleeve, wherein two axial extending ribs are disposed at the inner wall of the another end of the rotating tube member, a block is disposed between the two ribs, and a resisting member is disposed beside the two ribs; a press cover having two wedging member being extended outwardly and disposed on the two side edges thereof respectively, the one end of the press cover located at the wedging member being embedded at the inner edge of the free end of the rotating tube member, and the one wedging member being disposed beyond the two ribs; wherein the block stops pressing the press cover in order to stop outputting material in the cosmetic container and then achieve the function of preventing improper pressing, and the rotating tube member is then turned around, the two wedging members are moved to locations beside the resisting member so as to output the material.

Other and further features, advantages and benefits of the invention will become apparent in the following description taken in conjunction with the following drawings. It is to be understood that the foregoing general description and following detailed description are exemplary and explanatory but are not to be restrictive of the invention. The accompanying drawings are incorporated in and constitute a part of this application and, together with the description, serve to explain the principles of the invention in general terms. Like numerals refer to like parts throughout the disclosure.

BRIEF DESCRIPTION OF THE DRAWINGS

The objects, spirits, and advantages of the preferred embodiments of the present invention will be readily understood by the accompanying drawings and detailed descriptions, wherein.

DETAILED DESCRIPTION OF THE INVENTION

Figure 1:
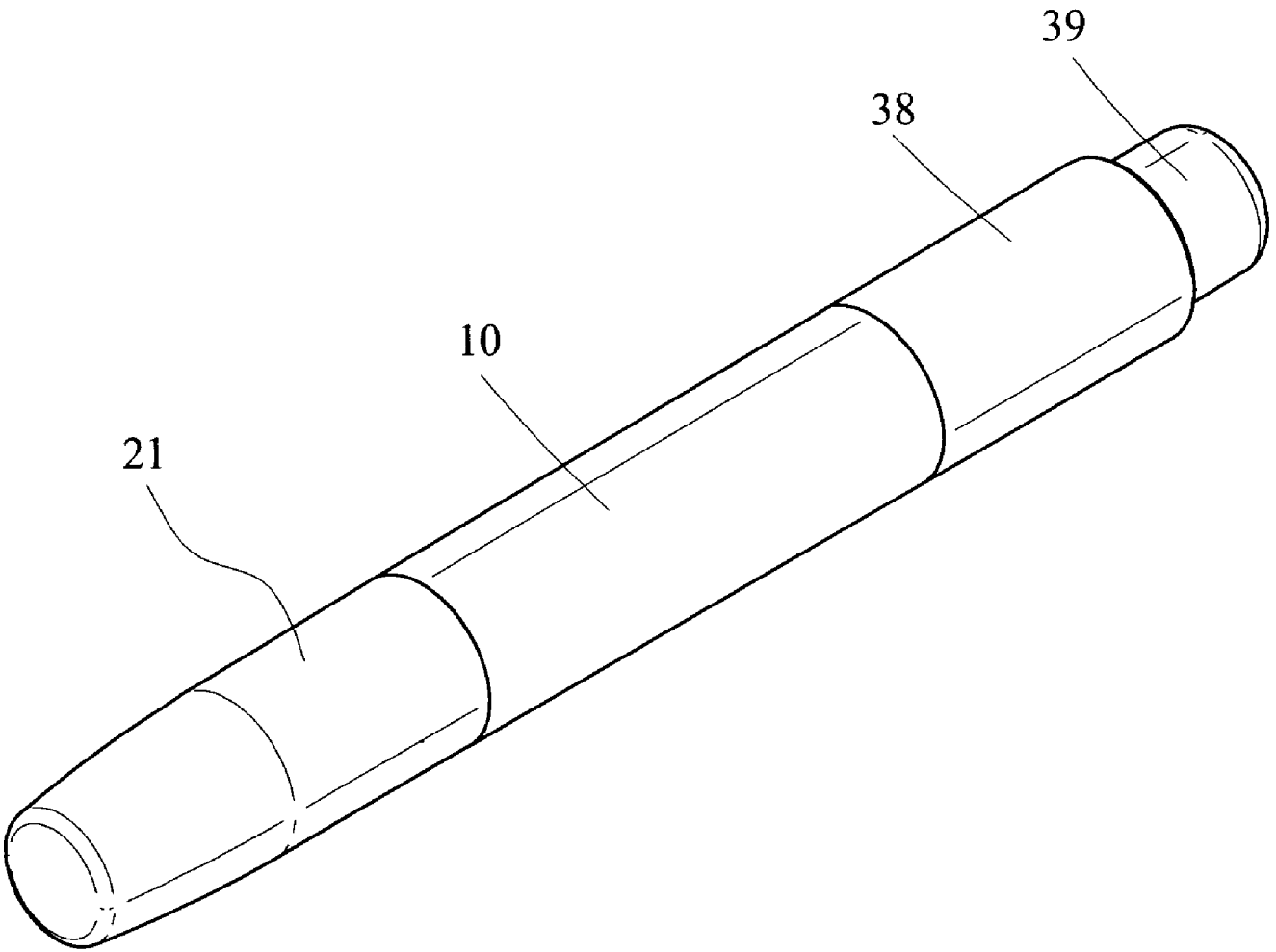
FIG. 1 illustrates a schematic 3-D view of the present invention.
Figure 2:
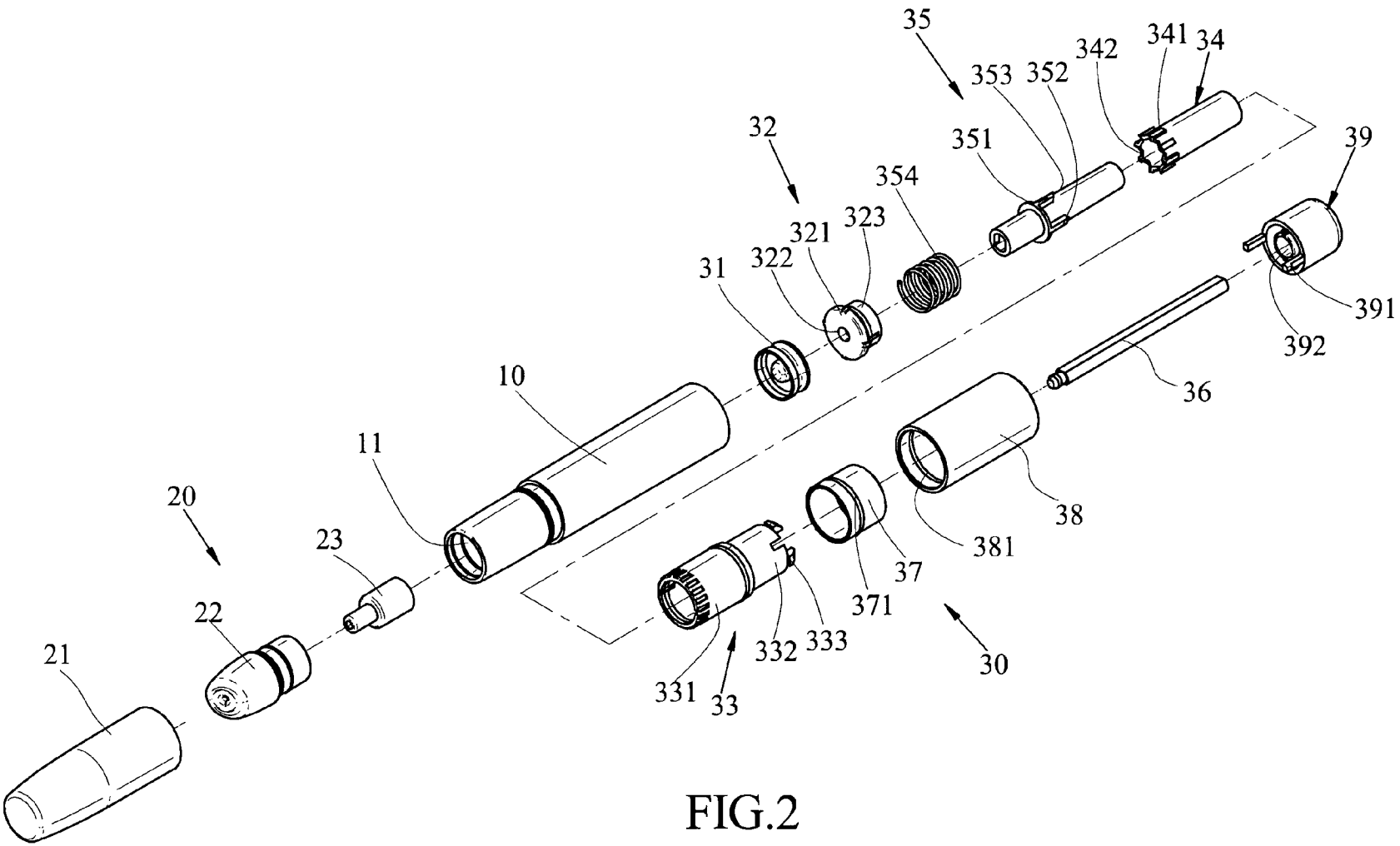
FIG. 2 illustrates a schematic 3-D exploded view of the present invention.
Figure 3:
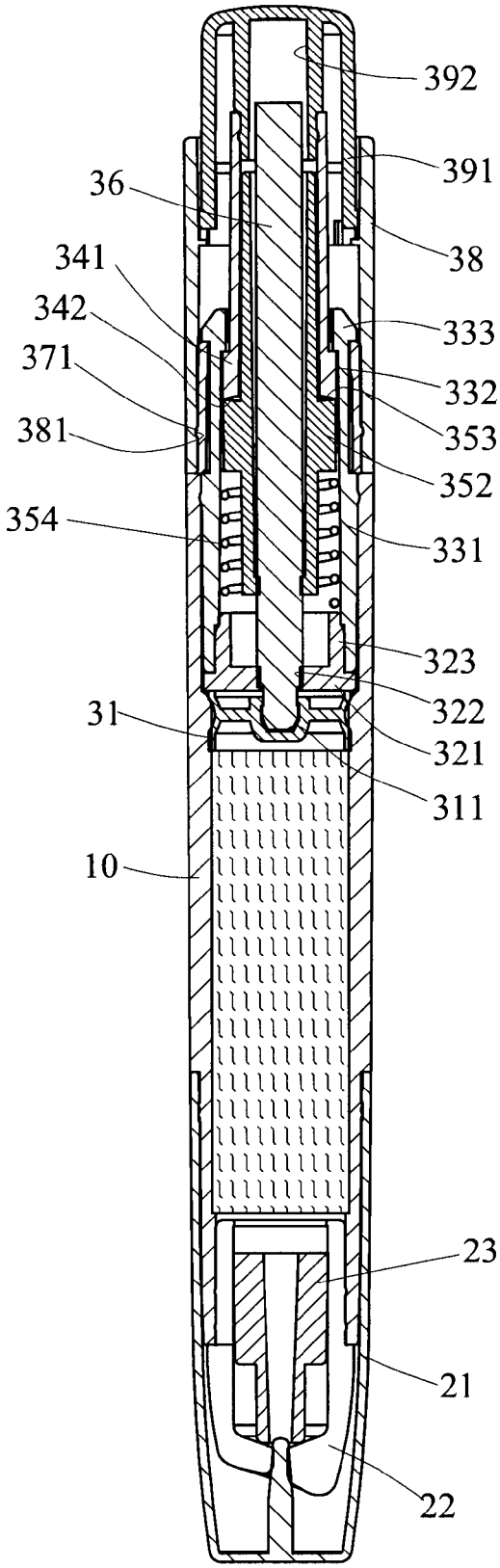
FIG. 3 illustrates a schematic sectional view of the present invention.
Figure 4:
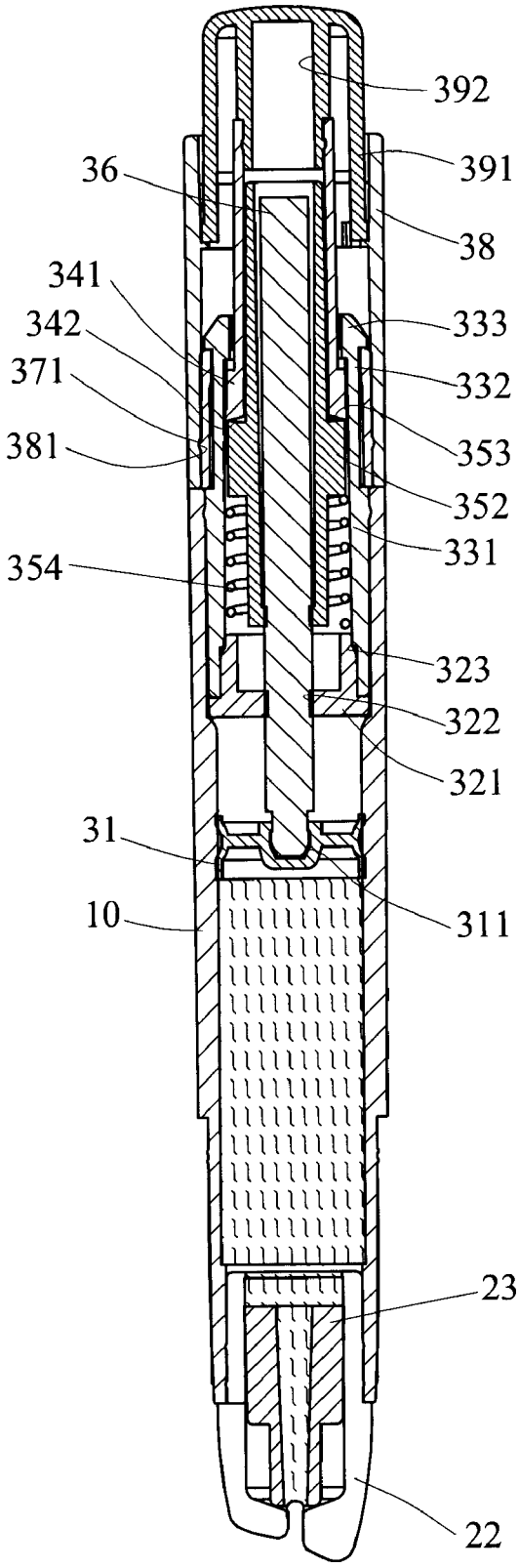
FIG. 4 illustrates another schematic sectional view of the present invention.
Figure 5B:
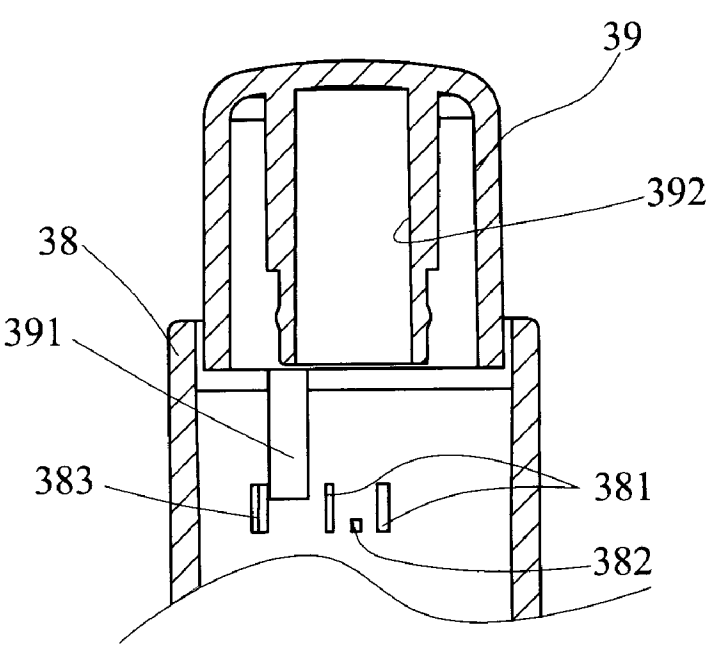
FIG. 5B illustrates a schematic view of not moving a press cover of the present invention.
Figure 5A:
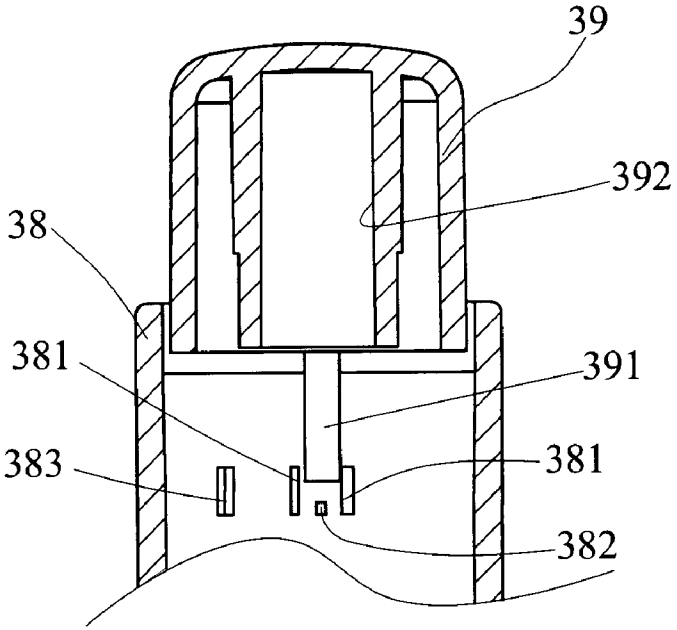
FIG. 5A illustrates a schematic sectional view of the motions of pressing and outputting of the present invention.

With references to FIG. 1 to FIG. 5, the present invention provides a press-type cosmetic container with an anti-press means comprising: a tube member 10, which is an axially hollow member and has an accommodation 11 for containing cosmetic liquid, the one end of the tube member 10 having an output means 20, the one end of the tube member 10 being disposed a press means 30, wherein the tube member 10 is disposed the outer edge of the one end of the output means 20 and female-connected to a hollow lid 21;

the output means 20, which includes a fixing member 22 embedded at an opening of the one end of the accommodation 1, and an output tube 23 being disposed at the axial center of the fixing member in order to discharge cosmetic liquid in the accommodation 1;

the press means 30 including: a platen 31 disposed at the one end of the tube member 10 without the output tube 23 in a sliding manner and around the opening of the accommodation 11 in order to press the cosmetic liquid moving toward the output tube 23 of the tube member 10, as shown in FIG. 3 and FIG. 4, wherein a slot hole 311 is disposed at the center of the top end surface of the platen 31 for embedding the rod member; a positioning kit 32, which comprises a flange disk 321, so that the positioning kit 32 is disposed at the top surface of the platen 31, a trepanning 322 is disposed at the center of the free end surface of the flange disk 321, and another ringer portion 323 is outwardly extended at the outer edge of the trepanning 322 on the flange disk 321; a claw socket member 33, which comprises a connecting socket portion 331 for female-connecting to the outer edge of the ringer portion 323 of the positioning kit 32, the connecting socket portion 331 being then embedded at the opening of the accommodation 11 of the tube member 10, the other end of the connecting socket portion 331 being outwardly extended a plurality of claw portions 332, a plurality of claw blocks 333 being formed at the end portions of the plurality of claw portions 332 and wider than the width formed by the claw portions 332; a thrust tube member 34, the one end surface of the one end of the thrust tube member 34 having a plurality of cone slots so as to form a plurality of sharp cone surfaces 342, a plurality of wedging blocks 341 being disposed at the outer edges of the ends of the sharp cone surfaces 342 and extended toward the other end of the thrust tube member 34, each interval of the wedging blocks 341 being equal to another, therefore the end of the thrust tube member 34 with cone slots being penetrated through the claw socket member 33, and the one end surface of each sharp cone surface 342 being against the one end surface of each claw block 333; a turning tube member 35, an extending flange 351 being disposed around the one end of the turning tube member 35, an embedding block 352 being extended toward the other end of the turning tube member 35 and connected to the outer edge of the turning tube member 35, the free end surface of the embedding block 352 being an embedding surface 353, the other end of the turning tube member 35 being penetrated through the thrust tube member 34 so as to make the embedding surface 353 match with the one side surface of the sharp cone surfaces 342; a flexible element 354, the one end of the flexible element 354 being against the end edge of the free end surface of the ringer portion 323 of the positioning kit 32, and the other end of the flexible element 354 being against the free end surface of the extending flange 351; a rod member 36, the one end of the rod member 36 being penetrating through the turning tube member 35 for embedding in the slot hole 311 of the platen 31, so that the rod member 36 and the turning tube member 35 are firmly fastened each other; a hollow bushing member 37, which is female-connected to the outer edge of the claw portion 332 and matched with the end surfaces of the claw blocks 333, a collar base 371 being disposed at the outer edge of the hollow bushing member 37; a hollow rotating tube member 38, the inner edge of the one end of the hollow rotating tube member 38 having a concave ring slot 384, and the hollow rotating tube member 38 being female-connected to the outer edges of the claw portions 332 and the hollow bushing member 37, and the concave ring slot 384 and the collar base 371 of the tube member 37 being matched each other in a sliding manner so as to make the rotating tube member 38 rotate on the tube member 37; wherein two axial extending ribs 381 are disposed at the inner wall of the another end of the rotating tube member 38, as shown in FIG. 5A and FIG. 5B, a block 382 is disposed between the two ribs 381, and a resisting member 383 is disposed beside the two ribs 381; and a press cover 39, which has two wedging members 391 extended outwardly and disposed on the two side edges thereof respectively, the center of the end surface of the wedging member 391 having a containing slot 392 on the press cover 39, the one end of the press cover 39 with the wedging member 391 being embedded in the inner edge of the free end of the rotating tube member 38, the other end of the rod member 36 being then penetrated through and fixed in the containing slot 392, and the wedging member 391 is then disposed beyond the two ribs 381, as shown in FIG. 5B.

With references to FIG. 3, FIG. 4, FIG. 5A, and FIG. 5B, turning the rotating tube member 38 is to let the wedging members 391 be right beside the resisting member 383, as shown in FIG. 5B. Pressing the press cover 39 makes the wedging members 391 move toward the rod member 36 along the resisting member 383. Continuously the press cover 39 pushes the rod member 36, and the rod member 36 drives the thrust tube member 34, as shown in FIG. 4, so that the thrust tube member 34 is moved toward the turning tube member 35. The sharp cone surfaces 342 and the embedding surface 353 urge the turning tube member 35 to rotate so as to make the extending flange 351 press the flexible element 354. Then the rod member 36 thrusts the platen 31 to press the cosmetic liquid moving toward the output tube 23.

In case of stopping discharging the cosmetic liquid, releasing the press cover 39 will recover the turning tube member 35 by means of the flexible element 354, and the press cover 39 is back to an original position as well.

With reference to FIG. 5B, while not using the cosmetic liquid, turning the rotating tube member 38 will make the wedging member 391 be in the interval of the two axial extending ribs 381 in order to let the block 382 stop that of pressing the press cover 39 down, and the turning tube member 35 can not be moved.

The present invention discloses the press-type cosmetic container, which has an anti-press means. So that the cosmetic liquid is not leaked so as to be very convenient for traveling.

Although this invention has been disclosed and illustrated with reference to particular embodiments, the principles involved are susceptible for use in numerous other embodiments that will be apparent to persons skilled in the art. This invention is, therefore, to be limited only as indicated by the scope of the appended claims.

What is claimed is:

1. A press-type cosmetic container with an anti-press means comprising:

a tube member having a sleeve at the one end thereof, the outer edge of the sleeve being disposed a collar base;

a rotating tube member being disposed a female ringing slot at the inner edge of the one end thereof, the rotating tube member being female-connected to the outer edge of the sleeve and the collar base of the tube member being slid on the female ringing slot so as to make the rotating tube member be turned around on the sleeve, wherein two axial extending ribs are disposed at the inner wall of the another end of the rotating tube member, a block is disposed between the two ribs, and a resisting member is disposed beside the two ribs;

a press cover having two wedging member being extended outwardly and disposed on the two side edges thereof respectively, the one end of the press cover located at the wedging member being embedded at the inner edge of the free end of the rotating tube member, and the one wedging member being disposed beyond the two ribs;

wherein the block stops pressing the press cover in order to stop outputting material in the cosmetic container and then achieve the function of preventing improper pressing, and the rotating tube member is then turned around, the two wedging members are moved to locations beside the resisting member so as to output the material.

2. The press-type cosmetic container with an anti-press means according to claim 1, wherein the tube member has an accommodation for containing cosmetic liquid, the other end of the tube member without the sleeve has an output means, which comprises an output tube disposed at an opening of the one end of the accommodation in order to discharge the cosmetic liquid.

3. The press-type cosmetic container with an anti-press means according to claim 2, wherein the output means comprises a hollow lid, the inner edge of the one end of the hollow lid is female-connected to the outer edge of the one end of the tube member, a fixing member is embedded at the opening, and an output tube is disposed at the axial center of the fixing member.

4. The press-type cosmetic container with an anti-press means according to claim 2, further comprising:

a platen being disposed at the one end of the tube member without the output tube in a sliding manner and around the opening in order to press the cosmetic liquid moving toward the output tube of the tube member;

a positioning kit, the one end surface of the positioning kit being disposed at the top surface of the platen, the other end surface being outwardly extended a ringer portion;

a claw socket member comprising a connecting socket portion for female-connecting to the outer edge of the ringer portion of the positioning kit, the connecting socket portion being then embedded at the opening, the other end of the connecting socket portion being outwardly extended a plurality of claw portions, a plurality of claw blocks being formed at the end portions of the plurality of claw portions and wider than the width formed by the claw portions;

a thrust tube member, the one end surface of the one end of the thrust tube member having a plurality of cone slots so as to form a plurality of sharp cone surfaces, a plurality of wedging blocks being disposed at the outer edges of the ends of the sharp cone surfaces and extended toward the other end of the thrust tube member, each interval of the wedging blocks being equal to another, therefore the end of the thrust tube member with cone slots being penetrated through the claw socket member, and the one end surface of each sharp cone surface being against the one end surface of each claw block;

a turning tube member, an extending flange being disposed around the one end of the turning tube member, an embedding block being extended toward the other end of the turning tube member and connected to the outer edge of the turning tube member, the free end surface of the embedding block being an embedding surface, the other end of the turning tube member being penetrated through the thrust tube member so as to make the embedding surface match with the one side surface of the sharp cone surfaces;

a flexible element, the one end of the flexible element being against the end edge of the free end surface of the ringer portion of the positioning kit, and the other end of the flexible element being against the free end surface of the extending flange;

a rod member, the one end of the rod member being penetrating through the turning tube member for embedding at the platen, so that the rod member and the turning tube member are firmly fastened each other;

a hollow bushing member being female-connected to the outer edge of the claw portion and matched with the end surfaces of the claw blocks; and a hollow rotating tube member, the inner edge of the one end of the hollow rotating tube member having a concave ring slot, and the hollow rotating tube member being female-connected to the outer edges of the claw portions and the hollow bushing member, and the concave ring slot and the collar base of the tube member being matched each other in a sliding manner so as to make the rotating tube member rotate on the tube member.

5. The press-type cosmetic container with an anti-press means according to claim 4, wherein a slot hole is disposed at the center of the top end surface of the platen for embedding the rod member.

6. The press-type cosmetic container with an anti-press means according to claim 4, wherein the positioning kit comprises a flange disk, so that the positioning kit is disposed at the top surface of the platen, a trepanning is disposed at the center of the free end surface of the flange disk, and another ringer portion is outwardly extended at the outer edge of the trepanning on the flange disk.

* * * * *